US005839373A

United States Patent [19]

Lin

[11] Patent Number: 5,839,373

[45] Date of Patent: Nov. 24, 1998

[54] ADJUSTABLE KEYBOARD RACK MOUNTING STRUCTURE

[76] Inventor: Chin-Chih Lin, 2F, No. 160, Shih Ta Road, Taipei, Taiwan

[21] Appl. No.: 1,605

[22] Filed: Dec. 31, 1997

[51] Int. Cl.[6] ..... A47F 5/00

[52] U.S. Cl. ..... 108/140; 108/6; 108/138; 248/284.1; 248/286.1; 248/918

[58] Field of Search ..... 108/5, 6, 138, 108/140, 143; 248/284.1, 286.1, 918

[56] References Cited

U.S. PATENT DOCUMENTS

| | | | |
|---|---|---|---|
| 4,691,888 | 9/1987 | Cotterill | 248/284.1 |
| 4,706,919 | 11/1987 | Soberalski et al. | 248/284.1 |
| 5,037,054 | 8/1991 | McConnell | 248/286.1 X |
| 5,145,136 | 9/1992 | McConnell | 248/284.1 |
| 5,211,367 | 5/1993 | Musculus | 248/284.1 |
| 5,257,767 | 11/1993 | McConnell | 248/284.1 |
| 5,626,323 | 5/1997 | Lechman et al. | 248/286.1 |
| 5,653,413 | 8/1997 | Fink | 248/286.1 |
| 5,683,064 | 11/1997 | Copeland et al. | 248/284.1 |
| 5,707,034 | 1/1998 | Cotterill | 248/284.1 |
| 5,775,657 | 7/1998 | Hung | 248/918 X |

*Primary Examiner*—Peter M. Cuomo
*Assistant Examiner*—Hanh V. Tran
*Attorney, Agent, or Firm*—Bacon & Thomas

[57] ABSTRACT

An adjustable keyboard rack mounting structure which includes a sliding track unit having two parallel fixed rails coupled to two transverse track mount fixed to the bottom side of the desk top of a computer deck and a sliding plate moved back and force between the fixed rails, a retainer plate coupled to one track mount and adapted to releasably lock the sliding plate when the sliding plate is moved to a front limit position, a swivel frame pivoted to the sliding plate, a connecting plate pivoted to the swivel frame and releasably locked by an elevation control device, two brackets pivoted to the connecting plate at two opposite sides and releasably locked by an angle control device and adapted to hold a keyboard carrier and a keyboard on the keyboard carrier.

4 Claims, 4 Drawing Sheets

ADJUSTABLE KEYBOARD RACK MOUNTING STRUCTURE

BACKGROUND OF THE INVENTION

The present invention relates to a keyboard rack for a computer desk, and more particularly to an adjustable keyboard rack that can be adjusted vertically as well as horizontally in different directions.

Various kinds of computer desks have been developed with the development of computers and computer peripheral equipment. A regular computer desk comprises a desk top for holding the computer mainframe and the monitor, and a retractable keyboard rack for carrying the keyboard. When in use, the retractable keyboard rack is pulled out of the computer desk. After use, the retractable keyboard rack is pushed back into the inside of the computer desk, so that the keyboard lies beneath the desk top. Although the retractable keyboard rack can be moved in and out of the computer desk, its elevation and angular position are not adjustable. When the retractable keyboard rack is pulled out of the computer desk, it cannot be adjusted to the desired angle to fit the user's operating posture. U.S. Pat. No. 5,037,054 discloses a keyboard rack designed to eliminate the aforesaid problem. The keyboard rack according to U.S. Pat. No. 5,037,054 can be adjusted horizontally as well as vertically to the desired angle.

SUMMARY OF THE INVENTION

It is the main object of the present invention to provide an adjustable keyboard rack that can be adjusted in all directions to the desired elevation and angle. According to the preferred embodiment of the present invention, the adjustable keyboard rack mounting structure comprises a sliding track unit having two parallel fixed rails coupled to two transverse track mount fixed to the bottom side of the desk top of a computer deck and a sliding plate moved back and force between the fixed rails, a retainer plate coupled to one track mount and adapted to releasably lock the sliding plate when the sliding plate is moved to a front limit position, a swivel frame pivoted to the sliding plate, a connecting plate pivoted to the swivel frame and releasably locked by an elevation control device, two brackets pivoted to the connecting plate at two opposite sides and releasably locked by an angle control device and adapted to hold a keyboard carrier and a keyboard on the keyboard carrier.

DETAILED DESCRIPTION OF THE PREFERRED EMBODIMENT

Figure 1:
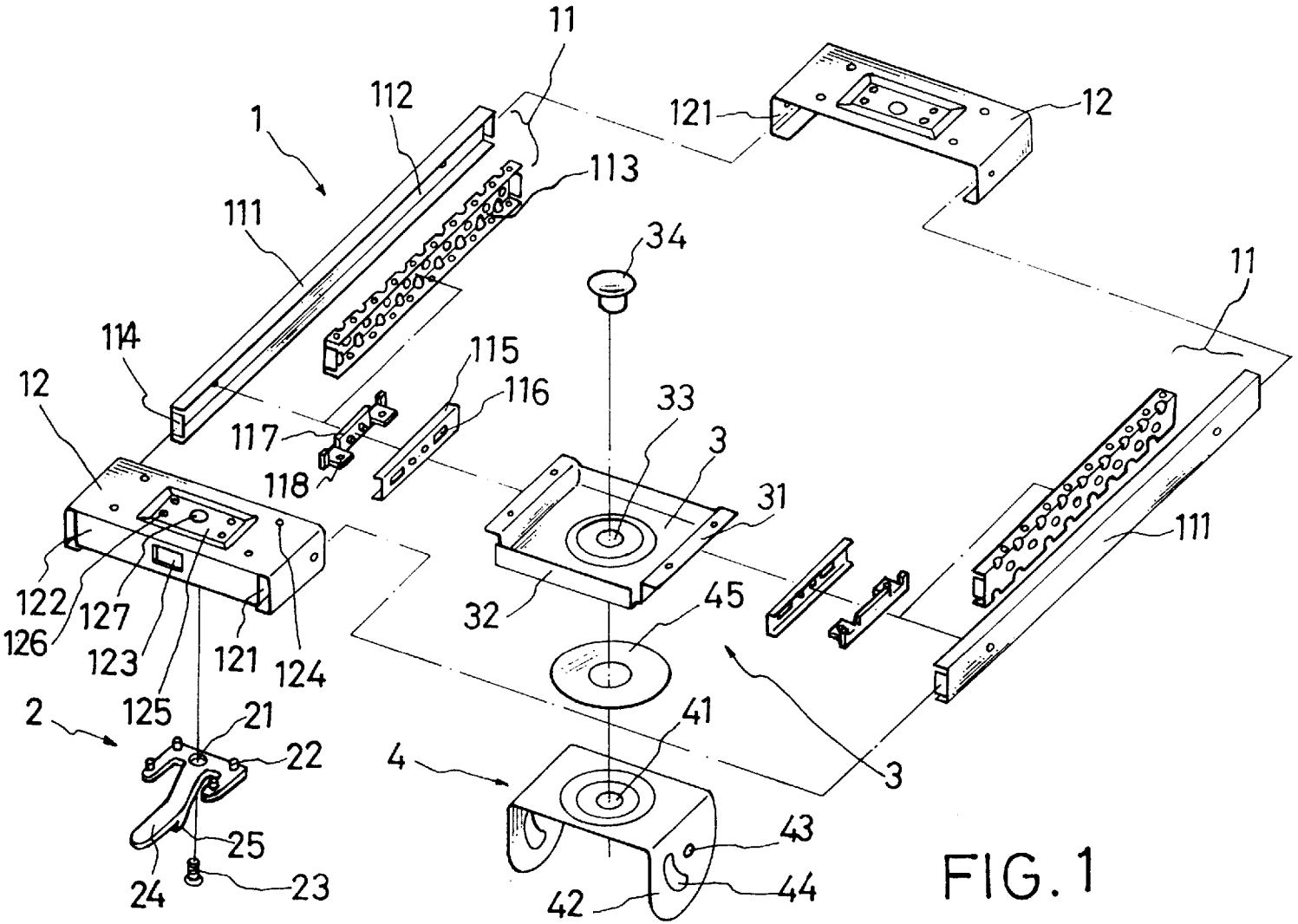
FIG. 1 is an exploded view of the sliding track unit, the retainer plate, the sliding plate and the swivel frame for the adjustable keyboard rack according to the present invention.
Figure 2:
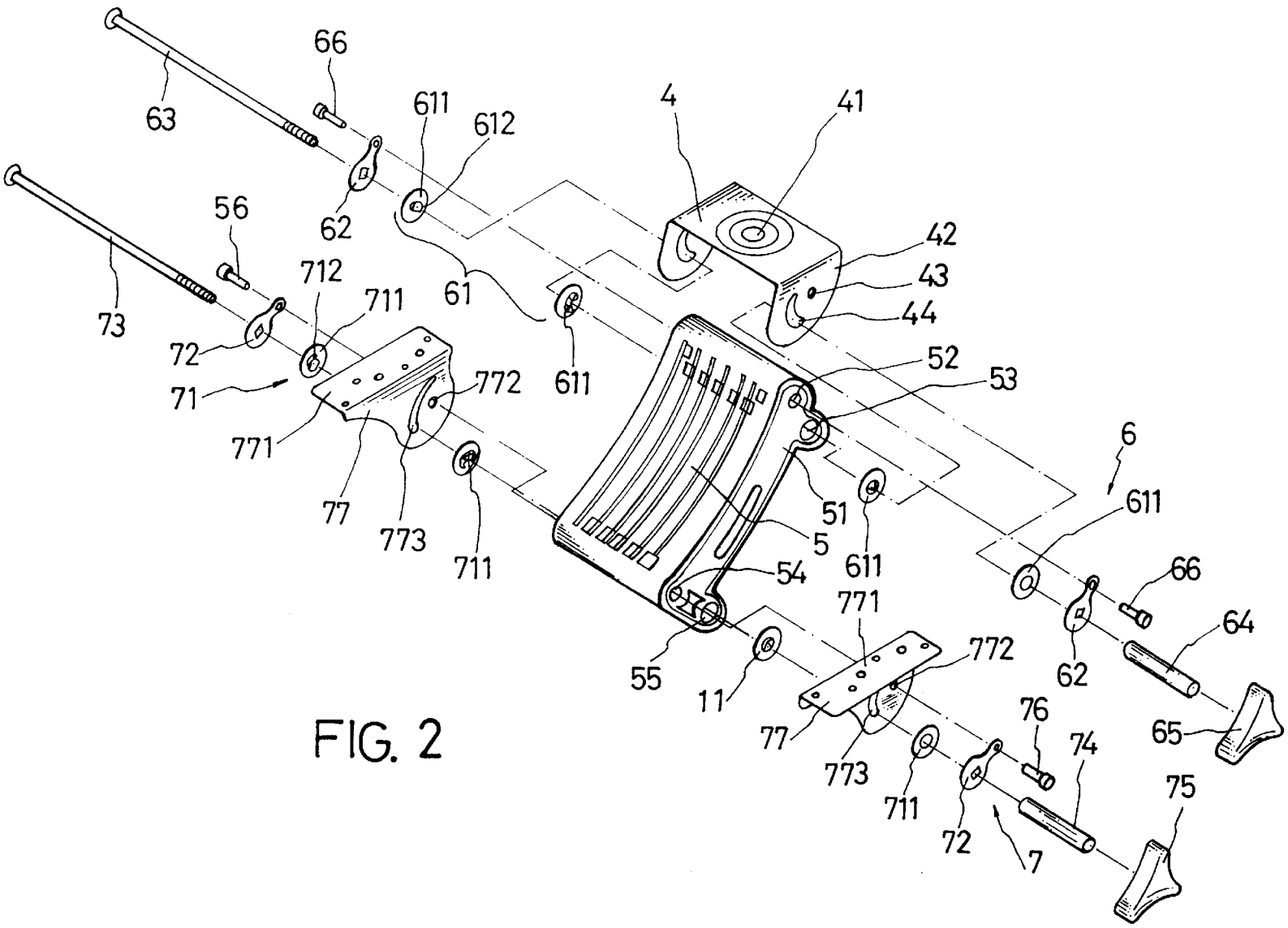
FIG. 2 is an exploded view of the swivel frame, the connecting plate, the elevation control device and the angle control device for the adjustable keyboard rack according to the present invention.
Figure 3:
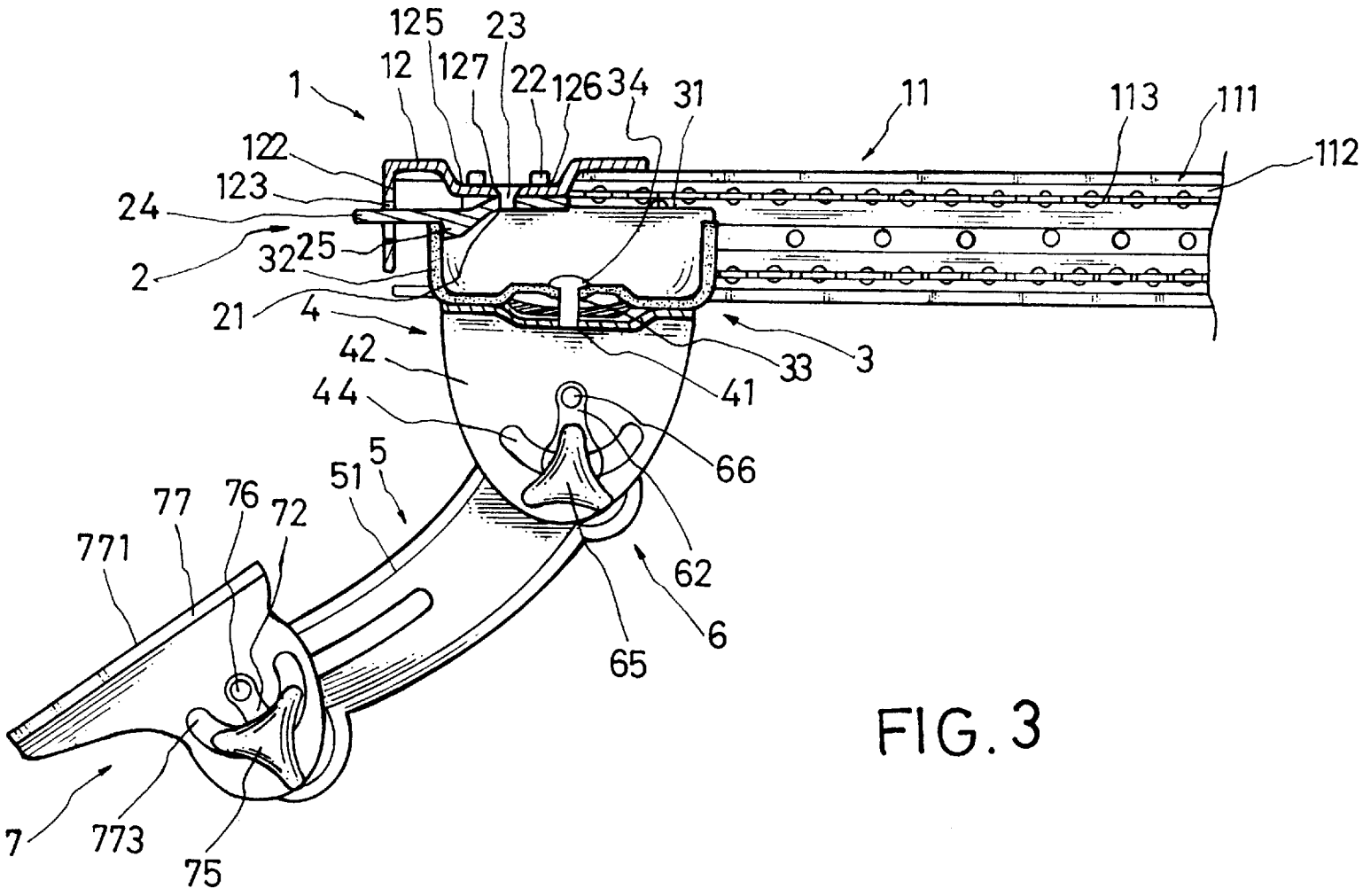
FIG. 3 is a side view partially in section of the adjustable keyboard rack according to the present invention.
Figure 4:
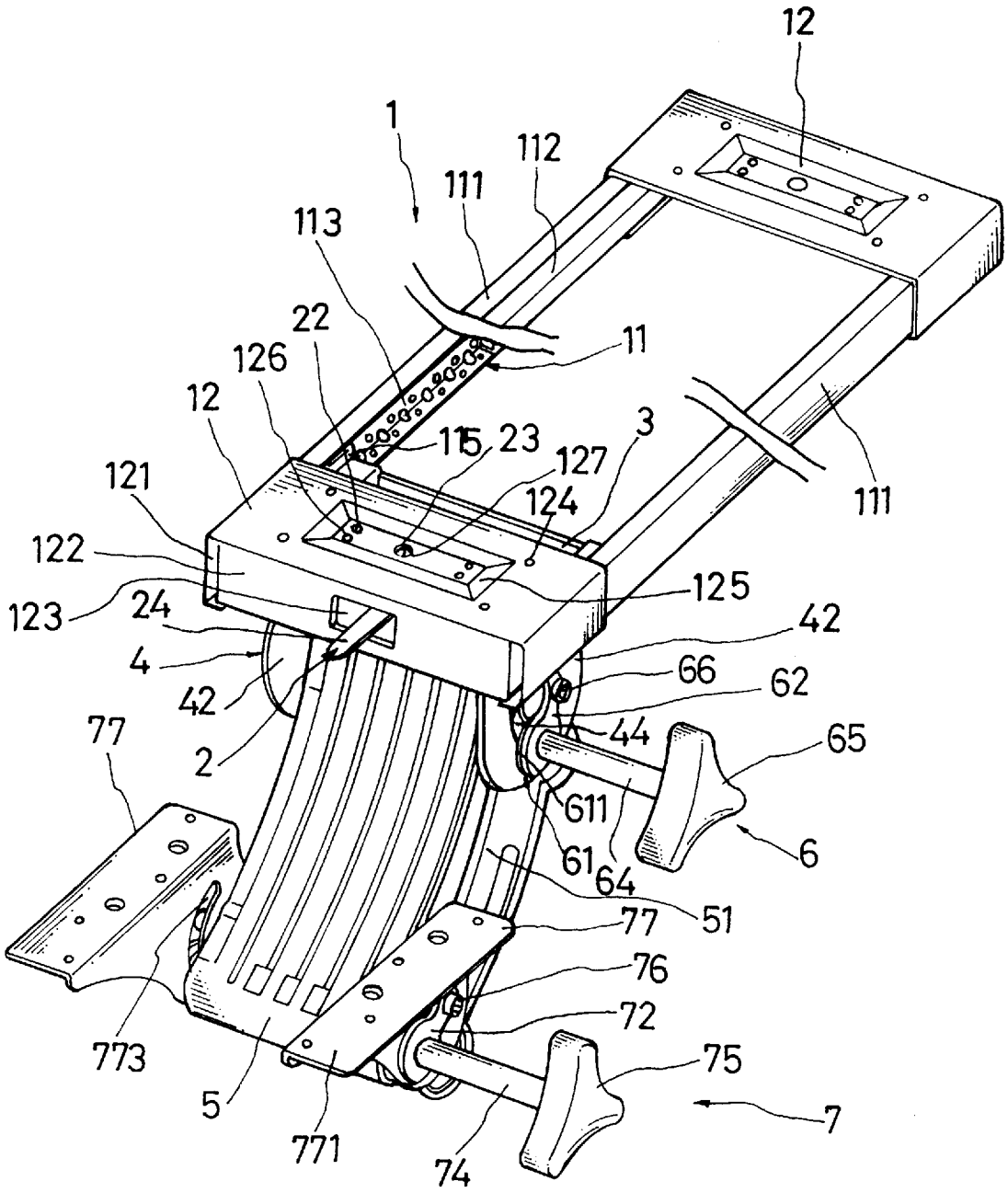
FIG. 4 is a perspective elevation of the adjustable keyboard rack according to the present invention.

Referring to Figures from 1 to 4, an adjustable keyboard rack in accordance with the present invention is generally comprised of a sliding track unit 1, a retainer plate 2, a sliding plate 3, a swivel frame 4, a connecting plate 5, an elevation control device 6, and an angle control device 7.

The sliding track unit 1 is comprised of two parallel sliding tracks 11, and two track mounts 12 transversely coupled to the sliding tracks 11 at front and rear ends. Each sliding track 11 is comprised of a fixed rail 111 defining a longitudinal sliding groove 112, and a movable rail 113 moved in the longitudinal sliding groove 112 inside the fixed rail 111. The movable rail 113 is shorter than the fixed rail 111, preferably mounted with balls for point contact with the fixed rail 111. The fixed rail 111 has two stop walls 114 respectively disposed at front and rear ends thereof to limit the movement of the movable rail 113 within the longitudinal sliding groove 112. An auxiliary rail 115 is coupled to the movable rail 113, having two slots 116 near its two opposite ends. A coupling plate 117 is mounted in between the movable rail 113 and the auxiliary rail 115, having two wings 118 near two opposite ends thereof respectively inserted through the slots 116 on the auxiliary rail 115 for connection to the sliding plate 3. Each track mount 12 comprises two sliding grooves 121 bilaterally disposed at the bottom which receive the fixed rails 111 of the sliding track unit 1, a vertical stop flange 122 stopped at the front ends or rear ends of the fixed rails 111, an insertion slot 123 at the center of the vertical stop flange 122, a plurality of top mounting holes 124 adapted for fastening to the desk top of the computer desk at the bottom side by screws, a top recess 125, a top center hole 127 at the center of the top recess 125, and a plurality of pin holes 126 at the top recess 125 around the top center hole 127.

The retainer plate 2 comprises a plurality of upright pins 22 respectively fitted into the pin holes 126 on the front sided track mount 12, a mounting hole 21 fixedly secured to the top center hole 127 on the corresponding track mount 12 by a screw 23, a projecting finger strip 24 extended out of the insertion slot 123 on the corresponding track mount 12, and a beveled bottom flange 25 disposed inside the corresponding track mount 12.

The sliding plate 3 comprises two horizontal side mounting flanges 31 respectively fastened to the wings 118 of the coupling plates 117 of the sliding tracks 11, a vertical front flange 32, and a center through hole 33.

The swivel frame 4 is a substantially U-shaped frame comprising a center hole 41 pivoted to the center through hole 33 on the sliding plate 3 by a rivet 34, and two downwardly extended side wings 42. Each side wing 42 is provided with a pivot hole 43, and an arched slot 44. Further, a washer 45 is mounted around the rivet 34 between the sliding plate 3 and the swivel frame 4.

When the sliding plate 3 is pulled outwards, the coupling plates 117 and auxiliary rails 115 of the sliding tracks 11 are respectively moved forwards along the longitudinal sliding grooves 112, and the front flange 32 of the sliding plate 3 is forced to pass over the beveled bottom flange 25 and to engage into the space between the beveled bottom flange 25 and the vertical stop flange 122 of the front sided track mount 12. Thus, the sliding plate 3 is stopped from backward movement, and the user can then start key-in operation. When not in use, the projecting finger strip 24 is pulled upwards to lift the beveled bottom flange 25, permitting the front flange 32 of the sliding plate 3 to be disengaged from the beveled bottom flange 25, and therefore the sliding plate 3 is allowed to be moved backwards to the inside of the computer desk.

The connecting plate 5 comprises two reinforcing plates 51 at two opposite lateral sides and connected between the two side wings 42 of the swivel frame 4. An upper pivot hole 52 and an upper swing hole 53 are provided at each reinforcing plate 51 at one end for coupling to the pivot holes 43 and arched slots 4 on the side wings 42 of the swivel frame 4. A lower pivot hole 54 and a lower swing hole 55 are provided at each reinforcing plate 51 at an opposite end.

The elevation control device 6 comprises two upper clamp units 61, each upper clamp unit 61 having two upper clamps 611, two first packing pieces 62, an upper screw rod 63, an upper extension tube 64, an upper knob 65, and two oppositely disposed upper pivots 66. The elevation control device 6 secures the swivel frame 4 to the upper part of the connecting plate 5. The upper screw rod 63 is inserted in proper order through one packing piece 62, one upper clamp unit 61, the arched slots 44 on the side wings 42 of the swivel frame 4, the upper swing holes 53 on the reinforcing plates 51, the other upper clamp unit 61, the other packing piece 62, and the upper extension tube 64, and then screwed up with the upper knob 65. The upper pivots 66 are inserted through the upper ends of the packing pieces 62 and fastened to the upper pivot holes 52 on the reinforcing plates 51 and the center holes 43 on the side wings 42 of the swivel frame 4. By turning the upper knob 65, the friction resistance between the upper clamp units 61 and the side wings 42 of the swivel frame 4 is released, for permitting connecting plate 5 to be turned about the upper pivots 66 to the desired elevation.

The angle control device 7 comprises two lower clamp units 71, each lower clamp unit 71 having two clamps 711, two second packing pieces 72, a lower screw rod 73, a lower extension tube 74, a lower knob 75, two oppositely disposed lower pivots 76, and two brackets 77. Each bracket 77 comprises a bearing surface 771 adapted to hold the keyboard carrier and a keyboard on the keyboard carrier (see U.S. patent application Ser. No. 08/598,002), a pivot hole 772 and an arched slot 773 at a vertical bottom wall thereof for coupling to the lower pivot hole 54 and lower swing hole 55 on one reinforcing plate 51. The lower screw rod 73 passes through the second packing pieces 72, the lower clamp units 71, the arched slots 773 on the brackets 77, the lower swing holes 55 on the reinforcing plates 51 and the lower extension tube 74, and then screwed up with the lower knob 75. The lower pivots 76 are respectively inserted through the second packing pieces 72 and the pivot holes 772 on the brackets 77, and then connected to the lower pivot holes 54 on the reinforcing plates 51. By turning the lower knob 75 the friction resistance between the lower clamp units 71 and the brackets 77 is released, for permitting connecting plate 5 to be turned about the lower pivots 76 to the desired angle.

Furthermore, the upper clamps 611 and the lower clamps 711 are provided with a respective stud 612;712 respectively inserted into the corresponding pivot holes 43;772 and arched slots 44;773 on the swivel frame 4 and the brackets 77. The clamps 611;711 are made from resilient plastics so that they can be firmly clamped on the corresponding members.

As indicated above, the retainer plate 2 stops the sliding plate 3 from backward movement after the keyboard has been pulled with the brackets 77 out of the computer desk; the swivel frame 4 can be turned about the rivet 34 relative to the sliding plate 3 to adjust the angular position of the keyboard horizontally; by means of controlling the upper knob 65 and the lower knob 75, the angular position of the keyboard is adjusted vertically.

While only one embodiment of the present invention has been shown and described, it will be understood that various modifications and changes could be made thereunto without departing from the spirit and scope of the invention disclosed.

What the invention claimed is:

1. An adjustable keyboard rack mounting structure comprising:

a sliding track unit, said sliding track unit comprising two parallel sliding tracks, and a front track mount and a rear track mount transversely coupled between said sliding tracks at front and rear sides and adapted for securing said sliding tracks to a desk top of a computer desk at a bottom side, said sliding tracks each comprised of a fixed rail defining a longitudinal sliding groove, a movable rail moved in the longitudinal sliding groove inside said fixed rail, said fixed rail having two stop walls respectively disposed at front and rear ends thereof to limit the movement of said movable rail within the longitudinal sliding groove on said fixed rail, an auxiliary rail coupled to said movable rail, said auxiliary rail having two slots near two opposite ends thereof, and a coupling plate mounted in between said movable rail and said auxiliary rail, said coupling plate having two wings respectively inserted through the slots on said auxiliary rail, said front track mount comprising two sliding grooves bilaterally disposed at a bottom side which receive the fixed rails of said sliding track unit, a vertical stop flange stopped against the fixed rails of said sliding tracks at one end, an insertion slot at the center of said vertical stop flange, a plurality of top mounting holes adapted for fastening to the desk top of the computer desk by screws, a top recess, a top center hole at the center of the said recess, and a plurality of pin holes at said top recess;

a retainer plate coupled to said front track mount, said retainer plate comprising a plurality of upright pins respectively fitted into the pin holes on said front track mount, a mounting hole fixedly secured to the top center hole on said front track mount by a screw, a projecting finger strip extended out of the insertion slot on said front track mount, and a beveled bottom flange raised from said projecting finger strip at a bottom side and disposed inside said front track mount;

a sliding plate coupled between said sliding tracks of said sliding track unit, said sliding plate comprising two horizontal side mounting flanges respectively fastened to the wings of said coupling plates of said sliding tracks, a vertical front flange, and a center through hole, the vertical front flange of said sliding plate being forced into engagement with the beveled bottom flange on said retainer plate to stop said sliding plate from a backward movement relative to the fixed rails of said sliding tracks of said sliding track unit when said sliding plate is pulled forwards, the vertical front flange of said sliding plate being disengaged from the beveled bottom flange on said retainer plate for permitting said sliding plate to be moved backwards with said movable rails of said sliding tracks along said fixed rails when said projecting finger strip is lifted with the hand;

a swivel frame pivoted to said sliding plate, said swivel frame comprising a center hole pivoted to the center through hole on said sliding plate by a rivet, and two downwardly extended side wings, each side wing of said swivel frame comprising a center pivot hole, and an arched slot;

a connecting plate coupled between the side wings of said swivel frame, said connecting plate comprising two upper pivot holes and two arched upper swing holes at one end of two opposite sides thereof, two lower pivot holes and two arched lower swing holes at an opposite end of the two opposite sides thereof;

an elevation control device, said elevation control device comprising two upper clamp units, two first packing pieces, an upper screw rod, an upper extension tube, an upper knob, and two oppositely disposed upper pivots, said upper screw rod being inserted in proper order through one first packing piece, one upper clamp unit, the arched slots on the side wings of said swivel frame, the upper swing holes on said connecting plate, the other upper clamp unit, the other packing piece and said upper extension tube, and then screwed up with said upper knob, said upper pivots being respectively inserted through respective holes on upper ends of said first packing pieces and fastened to the upper pivot holes on said connecting plate and the pivot holes on the side wings of said swivel frame, said upper clamp units being forced to clamp on said swivel frame and to fix said connecting plate and said swivel frame together when said upper knob is turned in one direction, said upper clamp units being released from said swivel frame when said upper knob is turned in the reversed direction, for permitting said connecting plate to be turned about said upper pivots to the desired elevation; and an angle control device, said angle control device comprising two lower clamp units, two second packing pieces, a lower screw rod, a lower extension tube, a lower knob, two oppositely disposed lower pivots, and two brackets, said brackets each comprising a bearing surface adapted to hold a keyboard carrier and a keyboard on said keyboard carrier, a pivot hole and an arched slot at a vertical bottom wall thereof for coupling to the lower pivot holes and lower swing holes on said connecting plate, said lower screw rod being inserted through said second packing pieces, said lower clamp units, the arched slots on said brackets, the lower swing holes on said reinforcing plates and said lower extension tube, and then screwed up with said lower knob, said lower pivots being respectively inserted through respective through holes on said second packing pieces and the pivot holes on said brackets, and then connected to the lower pivot holes on said connecting plate, said lower clamp units being forced to clamp on said brackets and to fix said connecting plate and said brackets together when said lower knob is turned in one direction, said lower clamp units being released from said brackets when said lower knob is turned in the reversed direction, for permitting said brackets to be turned about said lower pivots to the desired elevation.

2. The adjustable keyboard rack mounting structure of claim 1, wherein said upper clamp units and said lower clamp units comprise each two resilient plastic clamping plates.

3. The adjustable keyboard rack mounting structure of claim 2, wherein said resilient plastic clamping plates have each a respective stud respectively inserted into the pivot holes arched slots on said swivel frame and said brackets.

4. The adjustable keyboard rack mounting structure of claim 1, wherein said connecting plate has two reinforcing plates at two opposite sides.

* * * * *